US006301833B1

(12) United States Patent
Airikkala

(10) Patent No.: US 6,301,833 B1
(45) Date of Patent: Oct. 16, 2001

(54) CLAMPING DEVICE FOR SLIDING WINGS

(75) Inventor: Pekka Airikkala, Vantaa (FI)

(73) Assignee: Iloxi Oy, Vantaa (FI)

( * ) Notice: Subject to any disclaimer, the term of this patent is extended or adjusted under 35 U.S.C. 154(b) by 0 days.

(21) Appl. No.: 09/403,255

(22) PCT Filed: Mar. 17, 1998

(86) PCT No.: PCT/FI98/00233

§ 371 Date: Dec. 9, 1999

§ 102(e) Date: Dec. 9, 1999

(87) PCT Pub. No.: WO98/46851

PCT Pub. Date: Oct. 22, 1998

(30) Foreign Application Priority Data

Apr. 15, 1997 (FI) ..... 971574 U

(51) Int. Cl.[7] ..... E05D 13/00
(52) U.S. Cl. ..... 49/409; 49/127; 160/196.1
(58) Field of Search ..... 49/409, 410, 147, 49/148, 125, 127, 128, 130; 160/196.1, 199, 201, 206

(56) References Cited

U.S. PATENT DOCUMENTS 3,810,330 * 5/1974 Daggy ..... 49/127
5,448,855 * 9/1995 Sjoholm ..... 49/125
5,548,926 * 8/1996 Sjoholm ..... 49/127
6,065,247 * 5/2000 Sundvall ..... 49/127 X

FOREIGN PATENT DOCUMENTS

WO 93/08355 10/1992 (WO) ..... E05D/15/06
WO 94/19570 9/1993 (WO) ..... E05D/15/58

* cited by examiner

*Primary Examiner*—Jerry Redman

(57) ABSTRACT

A clamping device for panel elements (3) portable along a top and bottom guide rail (1, 2), the elements being fitted with a guide (4, 5) mounted on the top and bottom edge of an element, the guide rails (1, 2) being provided with a pivoting point for the element (3), at which the element (3) is pivotable relative to a pivot spindle (6) constituted by a guide (4) on the top edge of the element and a guide (5) on the bottom edge of the element, at least one of the guides (4, 5), which constitute the pivot spindle (6), being adapted to set in a clamped position in the guide rail (1, 2) as the element (3) is pivoted relative to said pivot spindle (6). The guide (4) is adapted to clamp in place includes a locking member (7) with a circular-segment shapped cross section, adapted to be non-rotatable relative to the element (3) and having a straight portion (8) which is aligned essentially in parallel with the guide rails (1, 2) as the element (3) travels along the guide rails. For the locking member(7), the element pivoting point is fitted with a guide (9), having one (11) of its parallel flanks (10, 11) facing each other provided with a circular-arc shaped recess (12). The circular-segment shaped locking member (7) has a smallest diametral dimension (d) which is less than a distance (a) between the straight flanks (10, 11) of the guide and a largest diametral dimension (D) which is substantially equal to a maximum distance (A) between the opposite flanks of the guide (9) at the circular-arc shaped recess (12).

4 Claims, 2 Drawing Sheets

CLAMPING DEVICE FOR SLIDING WINGS

CROSS REFERENCE TO RELATED APPLICATION

This is the U.S. National Phase of International Application No. PCT/FI98/00233 filed Mar. 17, 1998.

BACKGROUND OF THE INVENTION

The present invention relates to a clamping device for panel-like elements portable along a top and bottom guide rail, said elements being fitted with guide means mounted on the top and bottom edge of an element, said guide rails being provided with an element pivoting point, at which the element is pivotable relative to a pivot spindle constituted by a guide means on the top edge of the element and a guide means on the bottom edge of the element, at least one of the guide means, which constitute the pivot spindle, being adapted to set in a clamped position in the guide rail as the element is pivoted relative to said pivot spindle.

The above type of structures are used e.g. in balcony glass panels, whereby, if desired, the glass panels can be turned aside one by one and pivoted e.g. through 90° relative to a vertical pivot spindle.

In one such prior known system, the pivot spindle has a flattened portion which enters into a guide slot provided with circular extensions (FIGS. 2*a*, 2*b*). Thus, when turning a panel-like element for pivoting the spindle at an extension, the spindle is no longer capable of moving forward or backward. If, for example, due to structural tolerances, the spindle and its flattened portion are not completely within the circular extension when turning a panel-like element, a corner of the flattened portion collides with the guide edge. In order to avoid the collision in all circumstances, it is necessary to use a sufficiently loose clearance. However, the result of this is an unsteady structure.

SUMMARY OF THE INVENTION

An object of the invention is to provide a clamping device, the collision with one another of its components being prevented in all circumstances and the operation of said clamping device being nevertheless precise and without backlash.

According to the invention, this object has been achieved and a clamping device of the invention is characterized in that the guide means adapted to clamp in place includes a locking member with a circular-segment shaped cross-section, adapted to be non-rotatable relative to the element and having a straight portion which is aligned essentially in parallel with the guide rails as the element travels along the guide rails, that, for the locking member, the element pivoting point is fitted with a guide, having one of its parallel flanks facing each other provided with a circular-arc shaped recess, and that the circular-segment shaped locking member has a smallest diametral dimension which is less than a distance between the straight flanks of the guide and a largest diametral dimension which is substantially equal to a maximum distance between the opposite flanks of the guide at the circular-arc shaped recess.

One preferred embodiment of the invention is such that the locking member includes a curved external surface, having a radius of curvature which is substantially equal to that of the internal surface in the circular-arc shaped recess of the guide provided for the locking member.

BRIEF DESCRIPTION OF THE DRAWINGS

The invention will now be described in more detail with reference made to the accompanying drawing, in which.

DESCRIPTION OF THE PREFERRED EMBODIMENT

The clamping device of the invention is intended for panel-like elements 3, for example windows, doors, balcony glass elements or the like, movable along an upper and a lower guide rail 1, 2.

Figure 1:
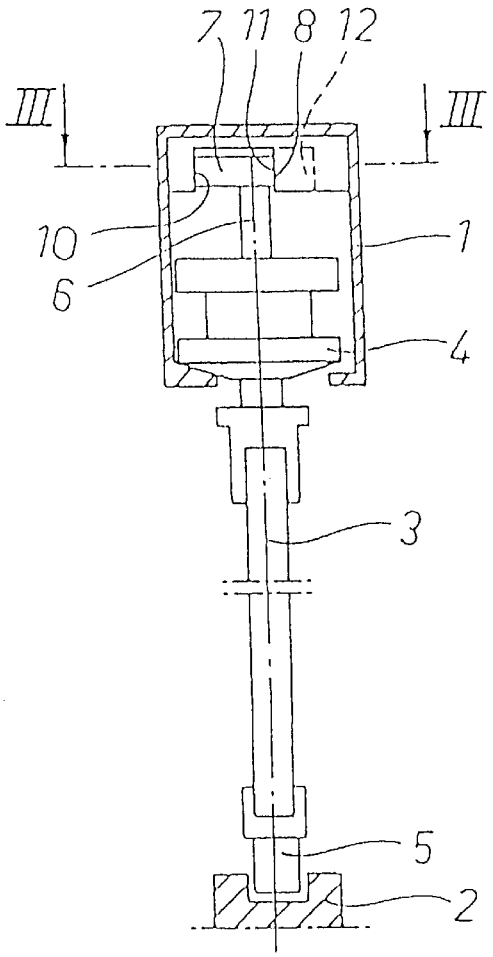
Fig. 1 Prior art
FIG. 1 is a vertical section, showing a panel-like element provided with a clamping device of the invention and movable along an upper and a lower guide rail.
Figure 2A:
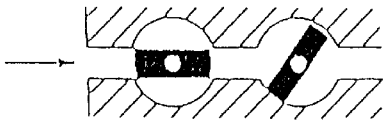
Fig. 2a Prior art
FIGS. 2*a* and 2*b* show a clamping device of the prior art in a section corresponding to a section along a sectional line III—III in FIG. 1.
Figure 2B:
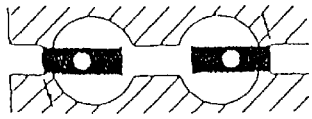

FIG. 1 illustrates in a schematic vertical section an element 3, movable along rails 1, 2 and provided with a clamping device of the invention.

The element 3 is provided with guide means 4, 5 mounted on the top and bottom edge of the element. The guide rails 1, 2 are provided for each element with a pivoting point, at which the element is capable of being turned relative to a pivot spindle 6 constituted by a guide means 4 at the top edge of the element 3 and by a guide means 5 at the bottom edge of the element 3. At least one of the guide means 4, 5 constituting the pivot spindle 6, preferably the upper one 4, is adapted to lock immovably in the guide rail as the element 3 is being turned relative to said pivot spindle 6. In other words, the movement of said guide means 4 in the direction of the guide rail 1 is prevented at said pivoting point by means of a clamping device as soon as the element is turned.

The guide means 4 adapted to lock in position includes a cross-sectionally circular-segment shaped locking member 7, arranged non-rotatably relative to the element 3 and having a straight portion 8 aligned substantially in parallel with the guide rails 1, 2 as the element 3 is travelling along the guide rails 1, 2. The locking member 7 comprises preferably a pin- or disc-like element. The central angle corresponding to the arc of the circular segment in the locking member 7 is at least 180°.

For the locking member 7, the pivoting point of the element 3 is provided with a guide 9, having one 11 of its opposite straight flanks 10, 11 provided with a circular-arc shaped recess 12. For each pivotable element 3, said guide 9 is provided with a separate recess 12.

The circular-segment shaped locking member 7 has a smallest diametral dimension d which is less than a distance a between the straight flanks 10, 11 of the guide 9 in order to secure an unimpeded movement for the locking member within the guide 9. Respectively, the circular-segment shaped locking member has a largest diametral dimension D which is essentially equal to a maximum distance A between the opposite flanks of the guide 9 at the circular-arc shaped recess 12 in order to secure the mutual absence of play between the locking member 7 and the guide 9 and, thus, a precise action with the element in a turned-aside position. This is further enhanced if the curved external surface of the locking member 7 has a radius of curvature r which is essentially equal to a radius of curvature R on the internal surface of the circular-arc shaped recess 12 in the guide 9 provided for the locking member 7.

The clamping device of the invention operates as follows.

Figure 3A:
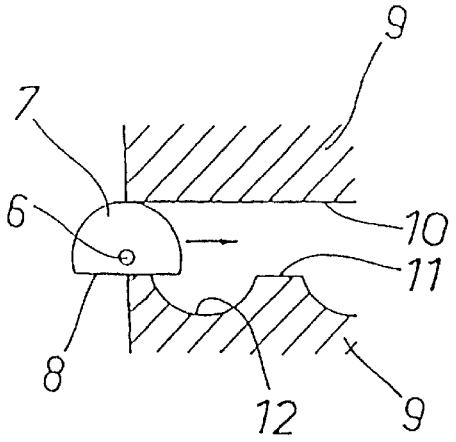
FIG. 3*a* shows a section along the line III—III in FIG. 1.

In FIG. 3*a*, the locking member 7 has moved along with the element 3 into a slot between the opposite flanks 10, 11 of the guide 3. In order to ensure an unimpeded movement, a suitable clearance is arranged between the locking member 7 and the flanks 10, 11.

Figure 3B:
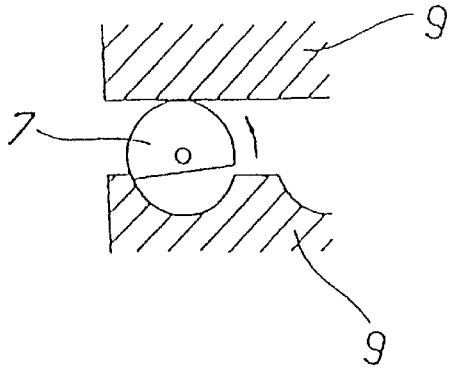
FIGS. 3*b*–3*e* show a section corresponding to FIG. 3*a* with the panel-like element pivoted in various positions.
Figure 3C:
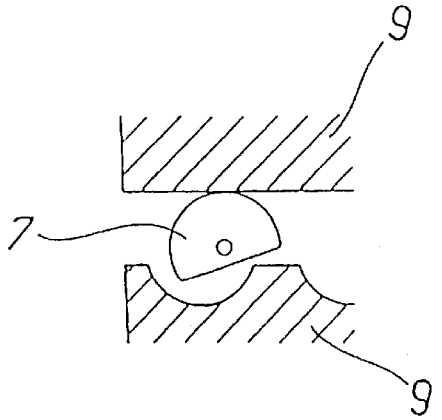

When the locking member 7 has reached a desired location, provided with a threshold not shown (FIG. 3*b*), the element 3 and, along with it, the locking member 7 can be pivoted for engaging the curved portion of the locking member 7 and the curved portion of the recess 12 of the guide 9 together (FIG. 3*d*) and for preventing a backward movement of the locking member 7 and, thus, the entire element 3.

Figure 3D:
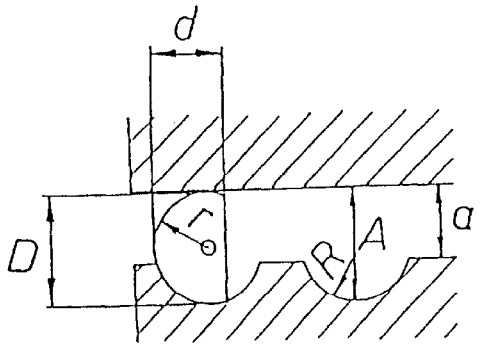
Figure 3E:
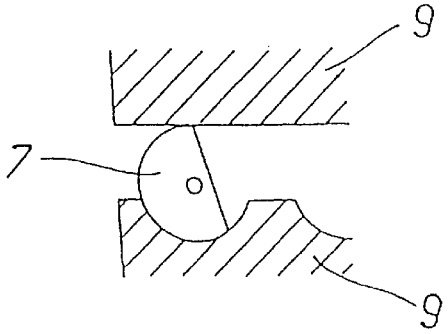

As depicted in FIG. 3*d*, the stopping of the locking member 7 can be effected with a sizable tolerance. In other words, the locking member 7 can be driven slightly beyond the optimal point shown in FIG. 3*d*.

As the locking member 7 pivots about 90° (FIG. 3*d*), the locking member 7 centres itself in the recess 12 and prevents the movement both forward and backward.

As depicted in fig. be, the locking member 7 can pivot more than 90° and still prevent effectively the movement forward, backward, and parallel to the element 3.

What is claimed is:

1. A clamping device in combination with a panel element (3) portable along a top and bottom guide rail (1,2), said element being fitted with guide means (4,5) mounted on the top and bottom edge of the element, said guide rails (1,2) being provided with a pivoting point for the element (3), at which the element (3) is pivotable relative to a pivot spindle (6) constituted by a guide means (4) on the top edge of the element and a guide means (5) on the bottom edge of the element, at least one of the guide means (4,5), which constitute the pivot spindle (6), being adapted to set in a clamped position in the guide rail (1,2) as the element (3) is pivoted relative to said pivot spindle (6), characterized in that the guide means (4) adapted to clamp in place includes a locking member (7) with a circular-segment shaped cross-section, adapted to be non-rotatable relative to the element (3) and having a straight portion (8) which is aligned essentially in parallel with the guide rails (1,2) as the element (3) travels along the guide rails, that, for the locking member (7), the pivoting point is fitted with a pivot guide (9), having one (11) of its parallel flanks (10, 11) facing each other provided with a circular-arc shaped recess (12), and that the circular-segment shaped cross-section of the locking member (7) has a smallest diametral dimension (d) which is less than a distance (a) between the straight flanks (10, 11) of the guide pivot and a largest diametral dimension (D) which is substantially equal to a maximum distance (A) between the opposite flanks of the pivot guide (9) at the circular-arc shaped recess (12).

2. A device as set forth in claim 1, characterized in that the circular-segment shaped cross-section of the locking member (7) includes a curved external surface having a radius of curvature (r) which is essentially equal to a radius of curvature (R) on the internal surface of the circular-arc shaped recess (12) in the guide (9) provided for the locking member (7).

3. A clamping device for a panel element having top and bottom edges slidable along respective top and bottom guide rails comprising:

top and bottom guide means connectable to the top and bottom edges and slidable along the respective top and bottom guide rails, said guide rails having a pivot location at which the element is pivotable relative to a pivot axis passing through a pivot spindle associated with said guide means, at least one of said guide means being adapted to be clamped at the pivot location as the element is pivoted;

the guide means includes a clamp member having a circular-segment shaped cross-section, non-rotatably fixed relative to the element and having a straight portion which is aligned essentially in parallel with the guide rails as the element travels along the guide rails;

the pivot location has facing parallel flanks, one of said flanks including a circular-arc shaped recess; and the clamp member has a minimum diametral dimension (d) which is less than the shortest distance (a) between the flanks and a maximum diametral dimension (D) which is substantially equal to the longest distance (A) between the flanks at said recess.

4. A clamping device according to claim 3, wherein the clamp member includes a curved external surface having a radius of curvature (r) which is essentially equal to a radius of curvature (R) on the internal surface of the recess.

* * * * *